US011554888B2

(12) United States Patent
Drocco

(10) Patent No.: US 11,554,888 B2
(45) Date of Patent: Jan. 17, 2023

(54) SELF-CLEANING DELIVERY HEAD FOR A DISPENSING MACHINE FOR DELIVERING FLUID PRODUCTS SUCH AS DYES FOR PAINTS OR THE LIKE

(71) Applicant: DROMONT S.p.A., Grinzane Cavour (IT)

(72) Inventor: Luca Drocco, Alba (IT)

(73) Assignee: DROMONT S.p.A.

( * ) Notice: Subject to any disclaimer, the term of this patent is extended or adjusted under 35 U.S.C. 154(b) by 278 days.

(21) Appl. No.: 16/882,807

(22) Filed: May 26, 2020

(65) Prior Publication Data

US 2020/0377248 A1 Dec. 3, 2020

(30) Foreign Application Priority Data

May 27, 2019 (IT) ..... 102019000007353

(51) Int. Cl.

| | |
|---|---|
| ***B05B 15/50*** | (2018.01) |
| ***B65B 39/00*** | (2006.01) |
| ***B05B 15/522*** | (2018.01) |
| ***B08B 1/00*** | (2006.01) |

(52) U.S. Cl.

CPC ..... *B65B 39/004* (2013.01); *B05B 15/50* (2018.02); *B05B 15/5225* (2018.02); *B08B 1/005* (2013.01); *B08B 1/008* (2013.01); *B65B 2039/009* (2013.01)

(58) Field of Classification Search

CPC . B65B 39/004; B65B 2039/009; B05B 15/50; B05B 15/5225; B08B 1/005; B08B 1/008; B01F 13/1055; B67C 3/26; B67C 3/22

See application file for complete search history.

(56) References Cited

U.S. PATENT DOCUMENTS

| | | | | |
|---|---|---|---|---|
| 876,453 A | | 1/1908 | Heard | |
| 3,029,847 A | * | 4/1962 | Heiss | B01F 15/0237 141/104 |
| 3,851,798 A | | 12/1974 | Miller | |
| 4,375,275 A | * | 3/1983 | Argazzi | F16K 1/38 239/117 |
| 5,762,098 A | * | 6/1998 | Manzone | B01F 13/1058 137/312 |
| 2012/0037268 A1 | * | 2/2012 | Masselin | B67D 7/02 141/83 |

FOREIGN PATENT DOCUMENTS

GB 2089002 A 6/1982

OTHER PUBLICATIONS

Italian Search Report dated Feb. 4, 2020. 8 pages.

* cited by examiner

*Primary Examiner* — Nicolas A Arnett

(74) *Attorney, Agent, or Firm* — RMCK Law Group PLC

(57) ABSTRACT

A delivery head for a dispensing machine for delivering fluid products, including: a tubular casing having a vertical longitudinal axis, a plurality of nozzles carried by the tubular casing and having respective outlet openings with axes parallel to the vertical longitudinal axis, and a cleaning device for automatically cleaning the nozzles, having a plurality of scraper tubes associated with respective nozzles, movable in a direction of the vertical longitudinal axis between a raised position and a lowered position, and vice versa, and having respective lower ends that clean the nozzles during a stroke from the raised position to the lowered position.

7 Claims, 3 Drawing Sheets

SELF-CLEANING DELIVERY HEAD FOR A DISPENSING MACHINE FOR DELIVERING FLUID PRODUCTS SUCH AS DYES FOR PAINTS OR THE LIKE

CROSS-REFERENCE TO RELATED APPLICATION

This application claims priority to Italian Patent Application No. 102019000007353 filed May 27, 2019. The disclosure of the above application is incorporated herein by reference in its entirety.

FIELD OF THE INVENTION

The present invention relates—in general—to dispensing machines for delivering fluid products such as dyes for paints or the like.

More precisely, the invention relates to a delivery head for a dispensing machine.

The invention was developed in particular with a view to the application to dispensing machines for delivering dyes for preparing paints. In the following description, reference will be made to this specific application field without, however, losing generality.

DESCRIPTION OF THE PRIOR ART

A dispensing machine for delivering dyes for preparing paints generally comprises a plurality of containers which, in the case of so-called "simultaneous machines", are connected to a single delivery head by means of respective ducts. A plurality of dispensing pumps feed dosed quantities of dyes from the containers to the delivery head.

The delivery head usually comprises a plurality of nozzles with a vertical axis, parallel to each other and open at their lower ends, each of which is connected to a respective container through a respective duct.

Delivery of the dyes from the nozzles of the delivery head is typically discontinuous. When delivery of the dye ends, elongated drops of dyes form, which protrude from the lower ends of the nozzles of the delivery head.

If the drops of dyes protruding from the lower ends of the nozzles remain exposed to the atmosphere for a long time, the dyes tend to solidify and form solid residues at the ends of the nozzles.

These solid residues compromise the regular operation of the dispensing machine. Therefore, after an extended stop of the dispensing machine, an operator is usually required to perform manual cleaning of the nozzles in order to physically eliminate these residues.

OBJECT AND SUMMARY OF THE INVENTION

The present invention aims to provide a delivery head for a dispensing machine for delivering fluid products that overcomes the problems of the prior art.

In particular, the present invention aims to provide a delivery head for a dispensing machine for delivering fluid products that does not require manual nozzle cleaning interventions.

According to the present invention, this object is achieved by a delivery head having the characteristics forming the subject of claim 1.

The claims form an integral part of the disclosure provided here in relation to the invention.

BRIEF DESCRIPTION OF THE DRAWINGS

The characteristics and advantages of the present invention will become apparent from the detailed description that follows, given purely by way of non-limiting example, with reference to the attached drawings, wherein.

DETAILED DESCRIPTION

Figure 1:
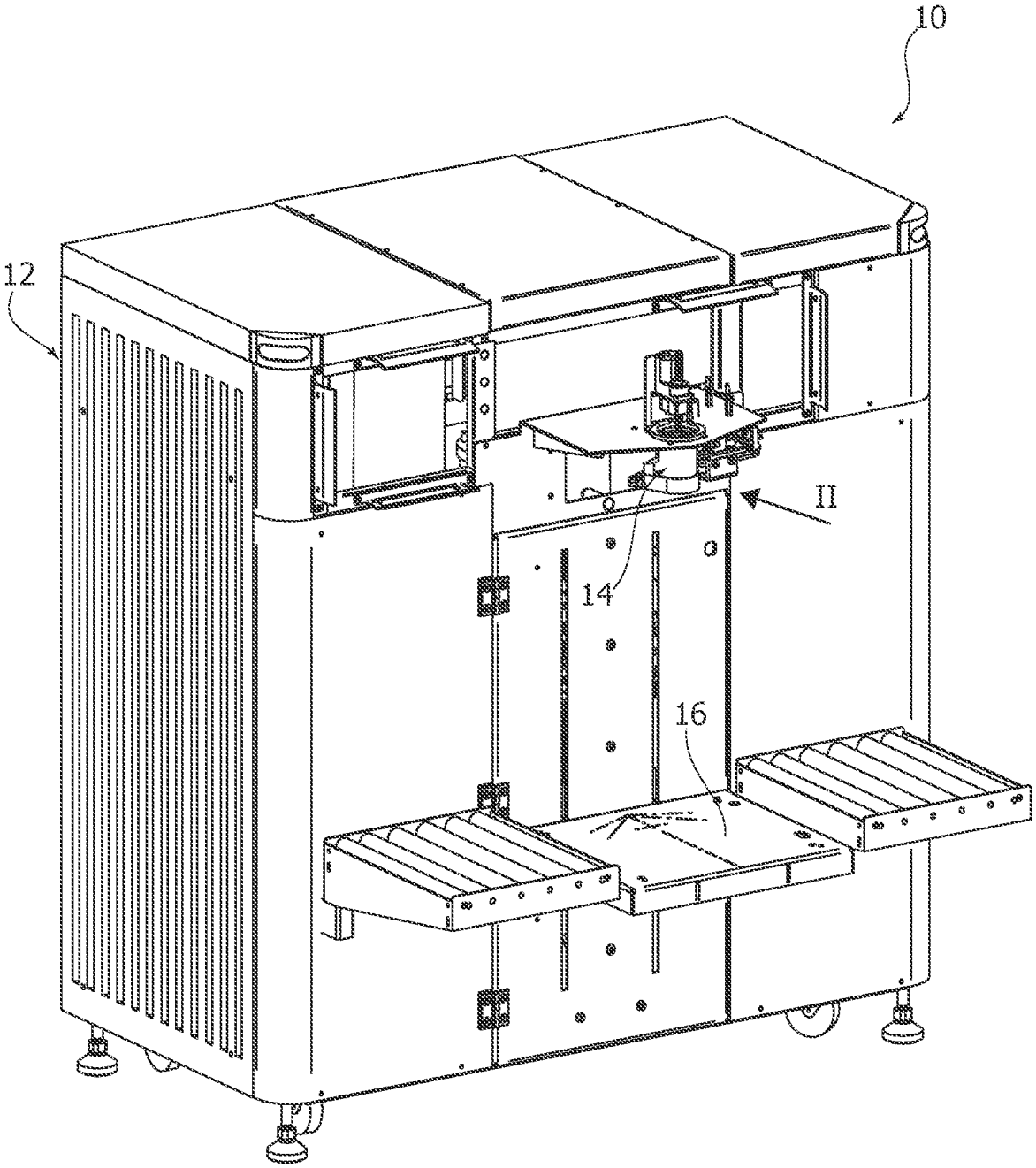
FIG. 1 is a perspective view of a dispensing machine provided with a delivery head according to the present invention.

With reference to FIG. 1, numeral 10 indicates a dispensing machine configured for delivering dosed quantities of fluid products, such as, for example, dyes for preparing paints. The machine 10 comprises a stock 12 in which a plurality of containers (canisters) containing different fluid products (typically dyes) are contained. The containers are connected to respective ducts by means of respective dispensing pumps. The ducts coming from the various containers of the machine 10 are connected to a delivery head 14. The machine 10 comprises a base 16 on which recipients are positioned into which the dyes dispensed by the delivery head 14 are poured.

Figure 2:
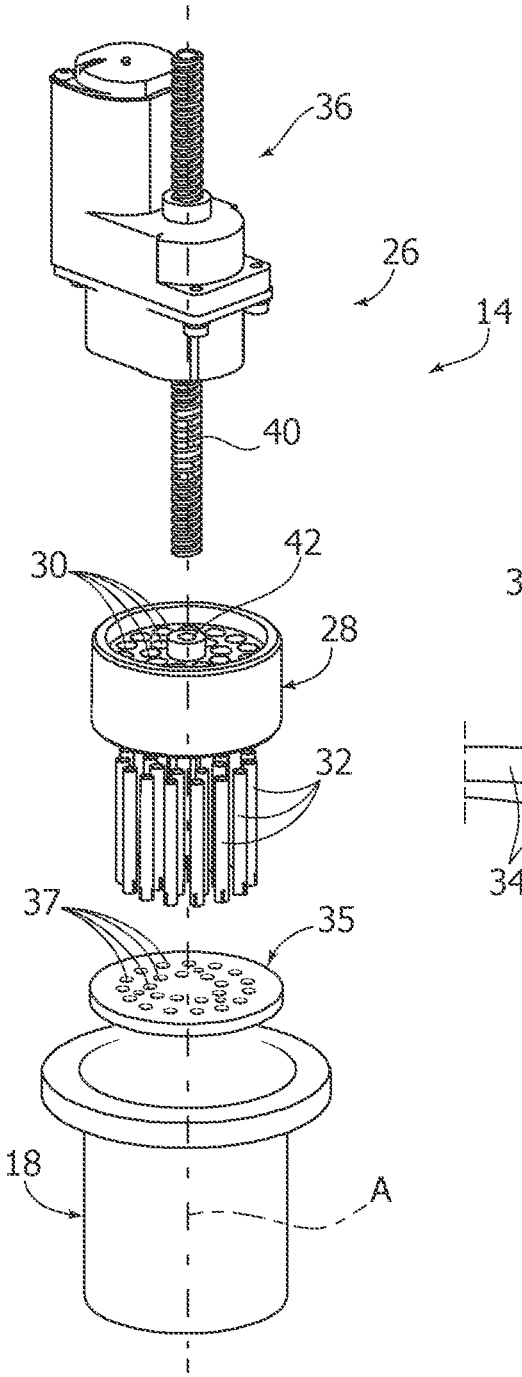
FIG. 2 is an exploded perspective view of the delivery head indicated by the arrow II in FIG. 1.
Figure 3:
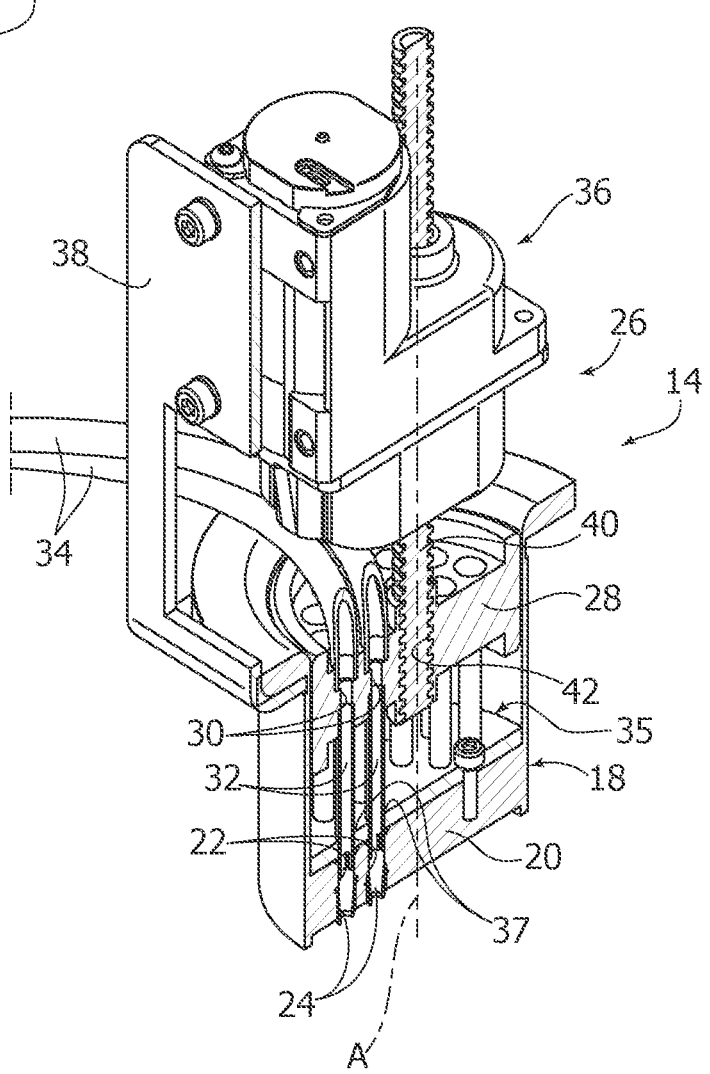
FIG. 3 is a partially cross-sectioned perspective view of the delivery head according to the present invention.

With reference to FIGS. 2 and 3, the delivery head 14 comprises a tubular casing 18 having a vertical longitudinal axis A.

A nozzle-holder plate 20 is arranged at a lower end of the tubular casing 18. A plurality of holes 22 are formed in the nozzle-holder plate 20 with respective axes parallel to the longitudinal axis A. The nozzle-holder plate 20 can be fixed to the tubular casing 18, or formed integrally with the tubular casing 18.

Each hole 22 of the nozzle-holder plate 20 carries a respective nozzle 24. The nozzles 24 can be formed of metal bushings inserted and fixed by interference, or other mechanical locking, within respective holes 22. The nozzles have respective nozzle axes coaxial with the axes of the respective holes 22. The nozzles 24 can have a truncated-conical shape tapered downwards, and have respective outlet openings coaxial to the respective nozzle axes. The nozzles 24 can have respective lower ends that project downwards with respect to the lower surface of the nozzle-holder plate 20.

The delivery head 14 comprises a cleaning device 26 configured to carry out the automatic cleaning of the nozzles 24. The cleaning device 26 is configured to remove solid residues of dyes adhering to the inner surfaces or to the edges of the outlet openings of the nozzles 24, which obstruct all or part of the useful section for dispensing of the nozzles 24.

The cleaning device 26 comprises a mobile support 28, which is located inside the tubular casing 18 above the nozzle-holder plate 20, and is movable with respect to the tubular casing 18 in the direction of the axis A between a raised position and a lowered position, and vice versa. The mobile support has a plurality of through-holes 30 with axes parallel to the longitudinal axis A.

The cleaning device 26 comprises a plurality of scraper tubes 32 parallel to the longitudinal axis A, which protrude downwards from the mobile support 28. The scraper tubes 32 have upper ends fixed within respective through-holes 30 of the mobile support 28, and lower ends that slidably engage respective holes 22 of the nozzle-holder plate 20. The scraper tubes 32 can be formed of rigid metal tubes with an outer diameter equal to or slightly greater than the diameter of the outlet openings of the nozzles 24. In the event that the outer diameter of the scraper tubes 32 is greater than the diameter of the outlet openings of the nozzles 24, the lower ends of the scraper tubes 32 may have axial slits that allow radial elastic compression towards the inside of the lower ends of the scraper tubes 32.

A retention system 35 capable of holding a plurality of sealing rings in a fixed position around respective scraper tubes 32 is made integrally with the nozzle-holder plate 20. This retention system may consist of an additional pressing disc having a plurality of holes 37 coaxial with respective holes 22 of the nozzle-holder plate 20 and crossed by the scraper tubes 22, or it can be formed by a seat integrally obtained in each of the nozzles 24. The aforesaid sealing rings prevent leakage of dye inside the head through the coupling surfaces between the scraper tubes 32 and the holes 22.

The dispensing machine 10 comprises a plurality of flexible tubes 34 for feeding the fluid products to the delivery head 14. The outlet ends of the flexible tubes 34 are fixed to the upper parts of the through-holes 30 of the mobile support 28.

The cleaning device 26 includes an actuator 36 which controls the movement in the direction of the axis A of the mobile support 28 with respect to the tubular casing 18. The actuator 36 can be carried by a flange 38 fixed to the tubular casing 18 and protruding upwards from the casing. The actuator 36 may comprise a rotary electric motor with a respective gearbox. The actuator may comprise a tie rod 40 translating in a direction parallel to the axis A fixed to the mobile support 28, or a driving screw 40 rotatable around the axis A, and which engages a thread 42 of the mobile support 28.

The operation of the delivery head 14 is as follows.

Figure 4:
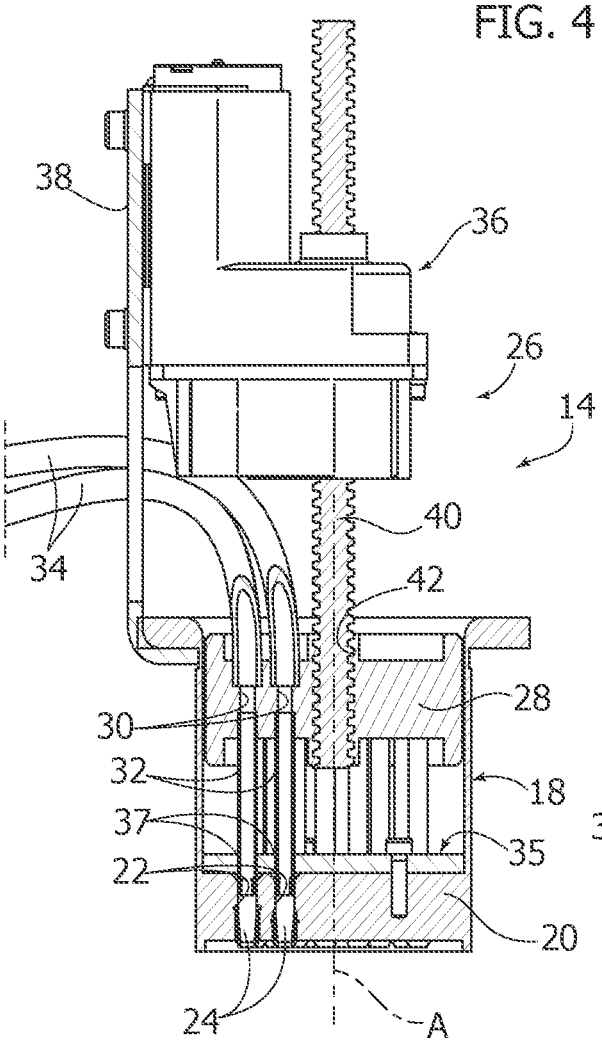
FIGS. 4 and 5 are axial sections of the delivery head according to the present invention in two operating positions.

During the delivery steps of fluid products the delivery head 14 is in the position shown in FIG. 4. In this position the mobile support 28 is in the raised position. The lower ends of the scraper tubes 32 engage the upper ends of the holes 22 of the nozzle-holder plate 20. The fluid products to be dispensed are fed to the delivery head 14 via the flexible ducts 34. The path of the dispensed fluids passes through the flexible ducts 34, the through-holes 30 of the mobile support 28, the scraper tubes 32, the holes 22 of the nozzle-holder plate 20 and the nozzles 24.

Figure 5:
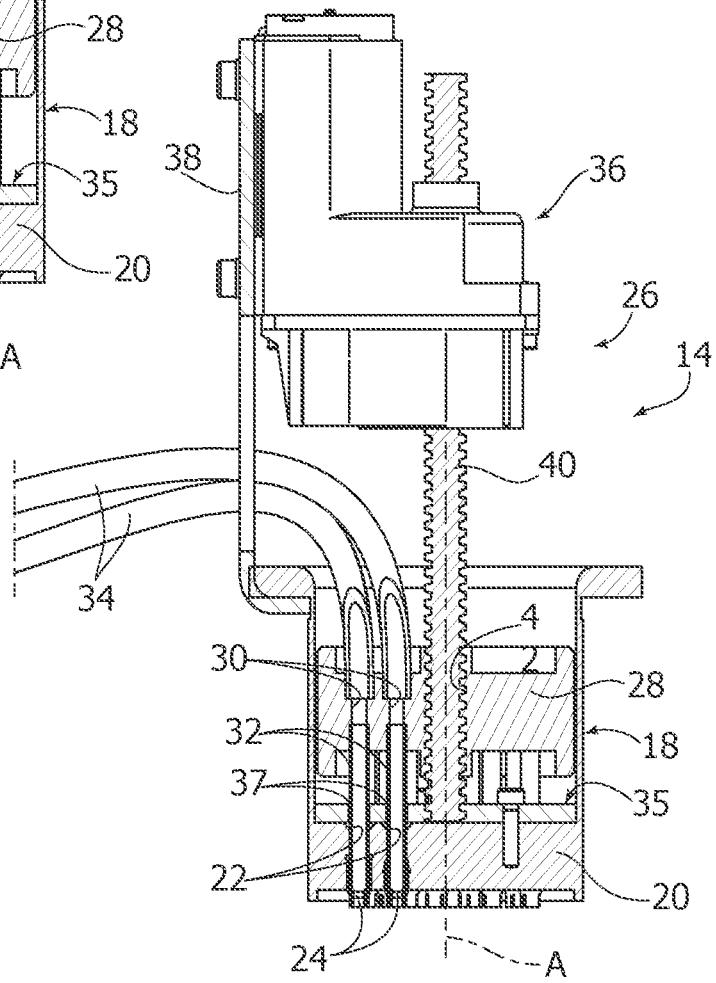

To carry out automatic cleaning of the nozzles 24, the delivery of fluid products is interrupted and, by means of the actuator 36, a downward movement of the mobile support 28 is commanded. FIG. 5 illustrates the position of the delivery head 14 at the end of the downward stroke of the mobile support 28. During the stroke from the top downwards of the mobile support 28, the scraper tubes 32 scrape the inner surfaces of the holes 22 of the nozzle-holder plate 20 and the inner surfaces of the nozzles 24, while the fluid present inside the scraper tubes, also moved forward together with the tubes themselves, pushes outward the fluid mass present in the inner volume of the holes 22 of the nozzle-holder plate 20 and in the inner volume of the nozzles 24. At the end of the downward stroke of the mobile support 28, the lower ends of the scraper tubes may protrude downwards slightly outside the respective nozzles 24.

The downward stroke of the scraper tubes 32 expels out of the nozzles 24 any agglomerates of solid or partially solid product formed in the holes 22 and/or in the nozzles 24 due to drying phenomena of the fluid product that remains in the nozzles between successive dispensing steps.

After the downward stroke, the mobile support 28 is returned to the raised position to return the delivery head 14 to the dispensing position.

The nozzle cleaning cycle can be carried out on command by the user, or it can be automatically controlled with a periodicity that can be chosen by the user.

The cleaning device 26 frees the dosing ducts from any partial or total obstructions, and has the double advantage of guaranteeing the correct execution of the dosing operation and of avoiding the occurrence of over-pressures in the dosing circuit consequent to possible obstructions, which could damage the dosing circuit.

The delivery head 14 can be applied both to new production dispensing machines and as a retrofit on existing machines, and is applicable to any model of dispensing machine.

The delivery head 14 according to the present invention avoids the need for manual interventions by the operators to clean the nozzles, and avoids the risk of malfunctions in the event of failure to perform the manual nozzle cleaning operations.

Of course, without prejudice to the principle of the invention, the details of construction and the embodiments can be widely varied with respect to those described and illustrated, without thereby departing from the scope of the invention as defined by the claims that follow.

The invention claimed is:

1. A delivery head for a dispensing machine for delivering fluid products, comprising:

a tubular casing having a vertical longitudinal axis, a plurality of nozzles carried by said tubular casing and having respective outlet openings with axes parallel to said longitudinal axis, a cleaning device for automatically cleaning the plurality of nozzles, comprising a plurality of scraper tubes associated with respective nozzles of the plurality of nozzles, wherein said scraper tubes are movable in a direction of said vertical longitudinal axis between a raised position and a lowered position, and vice versa, and have respective lower ends, which clean said plurality of nozzles during a stroke from the raised position to the lowered position.

2. The delivery head according to claim 1, wherein said cleaning device comprises a mobile support carrying said plurality of scraper tubes.

3. The delivery head according to claim 2, comprising a plurality of tubes for feeding fluid products, said plurality of tubes each having outlet ends connected to said mobile support, and wherein each of said plurality of tubes is in fluid connection with a respective scraper tube of said plurality of scraper tubes.

4. The delivery head according to claim 2, wherein said mobile support is associated with an actuator that controls a movement of the mobile support with respect to the tubular casing in the direction of said longitudinal axis (A) between the raised position and the lowered position, and vice versa, and wherein during the movement of the mobile support from the raised position to the lowered position, the lower ends of the plurality of scraper tubes move within respective nozzles of the plurality of nozzles.

5. The delivery head according claim 1, wherein said tubular casing carries a nozzle-holder plate having a plurality of holes within which respective nozzles of the plurality of nozzles are fixed.

6. The delivery head according to claim 5, wherein said plurality of holes of the nozzle-holder plate have upper parts, and wherein the lower ends of said plurality of scraper tubes, when in said raised position, engage said upper parts of said plurality of holes.

7. The delivery head according claim 1, wherein the lower ends of said plurality of scraper tubes in said lowered position protrude below the outlet openings of said plurality of nozzles.

* * * * *